US006779287B2

(12) United States Patent
Venegas, Jr.

(10) Patent No.: US 6,779,287 B2
(45) Date of Patent: Aug. 24, 2004

(54) INTEGRAL POST SLEEVE AND SIGN

(76) Inventor: Frank Venegas, Jr., 4165 Homestead, Howell, MI (US) 48843

( * ) Notice: Subject to any disclaimer, the term of this patent is extended or adjusted under 35 U.S.C. 154(b) by 5 days.

(21) Appl. No.: 09/855,087

(22) Filed: May 14, 2001

(65) Prior Publication Data

US 2001/0039750 A1 Nov. 15, 2001

Related U.S. Application Data

(60) Provisional application No. 60/203,972, filed on May 12, 2000.

(51) Int. Cl.[7] ..... G09F 7/22

(52) U.S. Cl. ..... 40/607; 40/607.03; 248/125.8; 248/159; 116/209

(58) Field of Search ..... 40/606, 607, 607.03; 248/125.8, 159; 116/209

(56) References Cited

U.S. PATENT DOCUMENTS

| | | | | | |
|---|---|---|---|---|---|
| 1,789,466 | A | * | 1/1931 | Horni | 40/606 |
| 2,450,345 | A | | 9/1948 | Kervin | 20/100 |
| 2,913,209 | A | | 11/1959 | Arnold | 248/201 |
| 3,080,149 | A | | 3/1963 | Pilboue | 256/57 |
| 3,172,220 | A | * | 3/1965 | Christensen | 40/606 |
| 3,181,849 | A | | 5/1965 | Mitchell | 267/1 |
| 3,355,998 | A | * | 12/1967 | Roemisch | 403/2 |
| 3,526,050 | A | * | 9/1970 | Weller | 40/606 |
| 3,667,405 | A | | 6/1972 | Roach, Jr. | 109/51 |
| 3,957,250 | A | | 5/1976 | Murphy | 256/19 |
| 3,986,248 | A | * | 10/1976 | Meshberg et al. | 29/458 |
| 3,991,532 | A | | 11/1976 | Buxbom | 52/297 |
| 4,019,301 | A | | 4/1977 | Fox | 52/725 |
| 4,021,977 | A | | 5/1977 | Deike | 52/98 |
| 4,060,222 | A | | 11/1977 | Pitkin et al. | 256/50 |
| 4,092,079 | A | | 5/1978 | Swanson | 403/306 |
| 4,110,989 | A | | 9/1978 | Selkirk | 405/248 |
| 4,244,156 | A | | 1/1981 | Watts, Jr. | 52/746 |
| 4,329,800 | A | * | 5/1982 | Shuman | 40/606 |

(List continued on next page.)

*Primary Examiner*—Cassandra Davis
(74) *Attorney, Agent, or Firm*—Gifford, Krass, Groh, Sprinkle, Anderson & Citkowski, PC

(57) ABSTRACT

A combined sleeve having an open bottom which fits over a post or other vertical member includes an integrated message panel formed in the upped end when installed. The combined sleeve and sign holder according to the invention is preferably made of synthetic/polymeric material such as polyethylene, polypropylene, vinyl, or any other sufficiently durable material, using any suitable process, including an injection mold, blow mold, or rotational-type mold. Depending upon the process used, the article may be fabricated as a unitary structure, or components may be joined through any suitable form of attachment process, including the use of adhesives and/or welding. The message may be supported to the sleeve in a variety of ways, depending upon the need for interchangeability vs. permanence. In the preferred embodiment, the signage is fully integrated into the upped end through the use of decals, which are included in the mold and integrally formed with the article during the molding process. In alternative embodiments a sign holder may be provided, enabling a changeable message to be loaded either from the front, or back, or both. A transparent forward panel may also be included to protect the signage.

5 Claims, 4 Drawing Sheets

U.S. PATENT DOCUMENTS

| | | | | | |
|---|---|---|---|---|---|
| 4,516,756 | A | | 5/1985 | Beatty | 256/1 |
| 4,644,722 | A | | 2/1987 | Phillips | 52/514 |
| 4,772,869 | A | * | 9/1988 | Grammas et al. | 116/63 C |
| 4,912,901 | A | | 4/1990 | Jerry | 52/301 |
| 4,961,258 | A | | 10/1990 | Menzel | 52/747 |
| 4,993,876 | A | | 2/1991 | Snow et al. | 405/216 |
| 5,093,209 | A | | 3/1992 | Kroisenbrunner | 428/682 |
| 5,141,207 | A | | 8/1992 | Meglino et al. | 256/33 |
| 5,170,996 | A | | 12/1992 | Venegas, Jr. et al. | 256/69 |
| 5,222,344 | A | | 6/1993 | Johnson | 52/728 |
| 5,261,647 | A | | 11/1993 | Venegas, Jr. et al. | 256/131 |
| 5,299,883 | A | | 4/1994 | Arth, Jr. | 404/10 |
| 5,311,713 | A | | 5/1994 | Goodrich | 52/301 |
| 5,312,089 | A | | 5/1994 | Venegas, Jr. | 256/65 |
| 5,323,583 | A | | 6/1994 | Venegas, Jr. | 52/727 |
| D349,164 | S | | 7/1994 | Fox | D25/38 |
| 5,354,037 | A | | 10/1994 | Venegas, Jr. | 256/59 |
| 5,364,077 | A | | 11/1994 | Venegas, Jr. et al. | 256/69 |
| 5,370,368 | A | | 12/1994 | Terrels et al. | 256/19 |
| 5,396,739 | A | | 3/1995 | Venegas, Jr. | 52/33 |
| 5,425,593 | A | | 6/1995 | Buehler | 403/305 |
| 5,557,900 | A | | 9/1996 | Shaneour | 52/736.3 |
| D374,941 | S | | 10/1996 | Venegas, Jr. | D25/126 |
| 5,566,927 | A | | 10/1996 | Venegas, Jr. | 256/59 |
| 5,577,714 | A | | 11/1996 | Venegas, Jr. | 256/65 |
| 5,624,103 | A | | 4/1997 | Venegas, Jr. | 256/66 |
| D380,274 | S | | 6/1997 | Stamets | D25/38 |
| 5,678,365 | A | | 10/1997 | Venegas, Jr. | 52/174 |
| 5,809,733 | A | | 9/1998 | Venegas, Jr. | 52/721.5 |
| 5,899,044 | A | | 5/1999 | Jarrett | 52/737.4 |
| 5,956,875 | A | | 9/1999 | Aughenbaugh | 40/607 |
| 5,992,069 | A | * | 11/1999 | McKew | 40/594 |
| 6,039,308 | A | | 3/2000 | Venegas, Jr. | 256/65 |
| D426,898 | S | | 6/2000 | Venegas, Jr. | D25/126 |

* cited by examiner

INTEGRAL POST SLEEVE AND SIGN

REFERENCE TO RELATED APPLICATION

This application claims priority from U.S. provisional patent application Ser. No. 60/203,972, filed May 12, 2000, the entire contents of which are incorporated herein by reference.

FIELD OF THE INVENTION

This invention relates generally to protective covers for posts, stanchions, and the like, and, more particularly, to a protective sleeve with integral signage.

BACKGROUND OF THE INVENTION

There are several inventions relating to protective coverings for posts, stanchions, guard rails, and other assemblies. The assignee to this application holds several issued U.S. patents and has other applications pending in this area. Of these, U.S. Pat. Nos. 6,209,276; 5,323,583; D426,898; and D374,941 are directed to covers for upright members such as stanchions, and the like.

There are situations, however, where posts in need of protection and informational signs are located in close proximity to one another. This is particularly true in parking lots, where upright posts are often used to guide or restrict the flow of traffic, and where signs are used to communicate parking limitations and potential penalties.

A common example involves the designation of handicap parking spots, requiring a sign associated with that designation, and often requiring upright members indicating the forward extent to which the vehicle should move to occupy that spot.

In the event that a sign is located substantially proximate to an upright post or stanchion in need of covering, the use of separate elements could be wasteful, unattractive, or both.

SUMMARY OF THE INVENTION

This invention addresses the combined need to cover certain types of upright members such as posts, stanchions, and the like, while, at the same time, providing for desired signage. Broadly, this goal is achieved through the use of a combined sleeve having an open bottom to fit over a post or other vertical member, including an integrated message panel formed in the upped end when installed.

In terms of construction, the combined sleeve and sign holder according to the invention is made of a molded synthetic/polymeric material such as polyethylene, polypropylene, vinyl, or any other sufficiently durable material. The article may be fabricated using any suitable process, though molding is preferred, whether an injection mold, blow mold, or rotational-type mold. Depending upon the process used, the article may be fabricated as a unitary structure, or components may be joined through any suitable form of attachment process, including the use of adhesives and/or welding.

The message may be supported to the sleeve in a variety of ways, depending upon the need for interchangeability vs. permanence. A transparent forward panel may also be included to protect the signage. In the preferred embodiment, the signage is fully integrated into the upped end through the use of decals, which are included in the mold and integrally formed with the article during the molding process. In alternative embodiments a sign holder may be provided, enabling a changeable message to be loaded either from the front, or back, or both.

DETAILED DESCRIPTION OF THE INVENTION

This invention addresses the combined need to cover certain types of upright members while, at the same time, providing desired signage. Broadly, this goal is achieved through the use of a sleeve having an open bottom and a upper, top portion including an integrated message panel.

Figure 1:
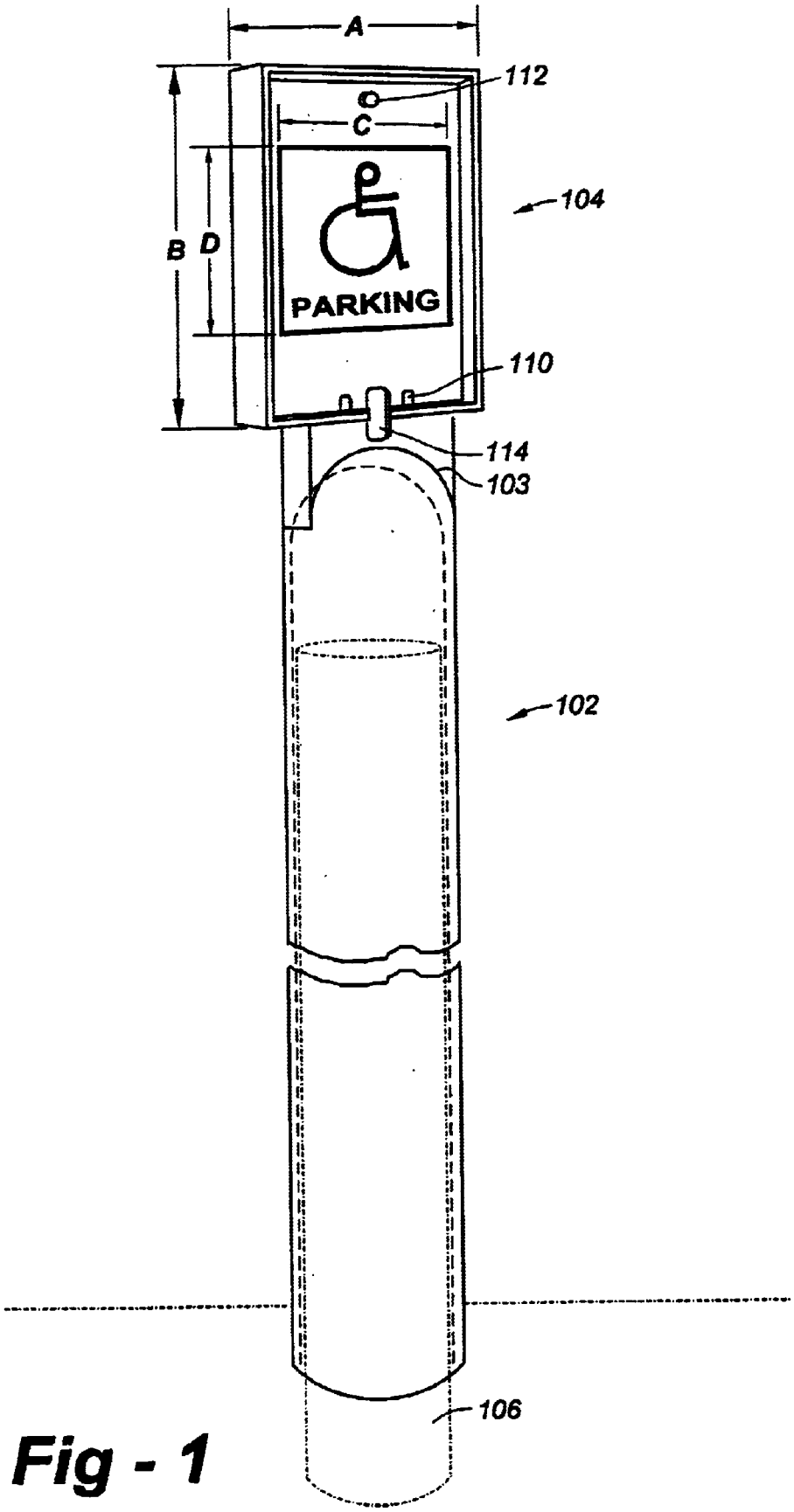
FIG. 1 is a front view drawing of a combined sleeve and sign holder according to a preferred embodiment of the invention.

FIG. 1 is a front view drawing of a preferred embodiment of the invention including a sleeve portion 102 and a signage portion 104. The sleeve features an upper end 103 with a hemispherical shape for decorative purposes, though other transitions may be used such as conical, faceted, and so forth. The sleeve 102 is preferably sized to fit over a stanchion 106 of the type wherein a steel pipe is often filled with cement and used out-of-doors. Thus, the sleeve 102 may be constructed in different sizes, for example, to fit posts/stanchions with outside diameters typically in the range of 2 to 8 inches, preferably at even-inch increments.

Integrally formed to the upper end of the sleeve 102 is an integral upper portion including an informational display. In this particular configuration, the upper portion has been produced according to the invention through the use of a decal which is inserted into the mold portion to receiving the molten polymeric material. The result is an image which is intimately bonded to the surface of the resulting product, resulting in an attractive, yet stable finished form.

Figure 2:
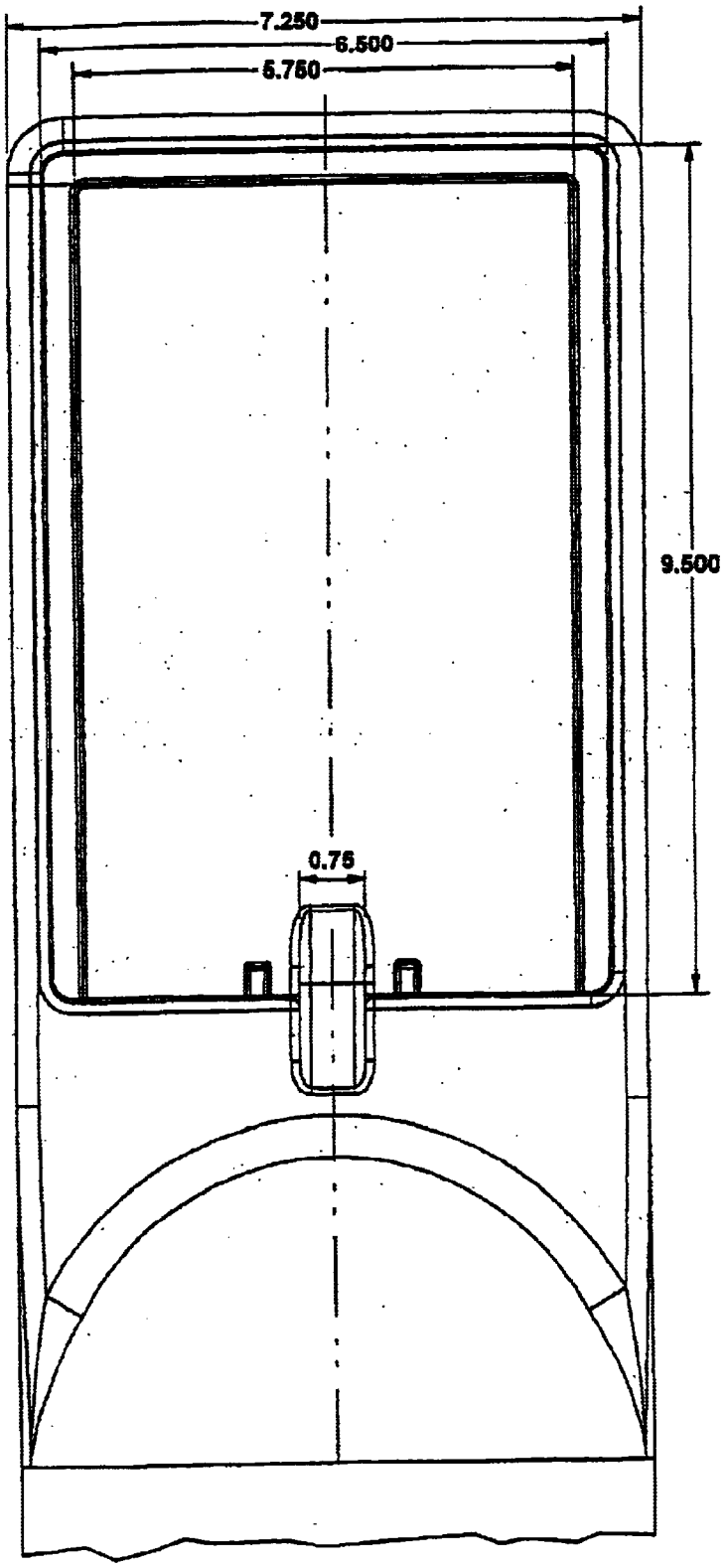
FIG. 2 is a front view drawing of an embodiment of the invention including a smaller sign integrally form with a larger-sized sleeve.

In terms of dimensions, the upper signage portion may be of a specific size to conform with codes or ordinances regarding such informational displays. For example, in some areas, dimension A should be substantially 12 inches, whereas dimension B substantially 18 inches. There are also requires that, for signs of the type shown in FIG. 1, that dimensions C and D should be at least six inches. Although combined sleeves and signs according to this invention may be made in conformity with such requirements, certainly dimensions may be varied. FIG. 2, for example, shows a combined sleeve and sign holder which will fit over a six inch O.D. post/stanchion, but which supports a sign less than 7×9 inches. With such a configuration, looking directly at the sign, the outer sides are substantially in line with the sides of the sleeve, resulting in a very sleek configuration.

Figure 3:
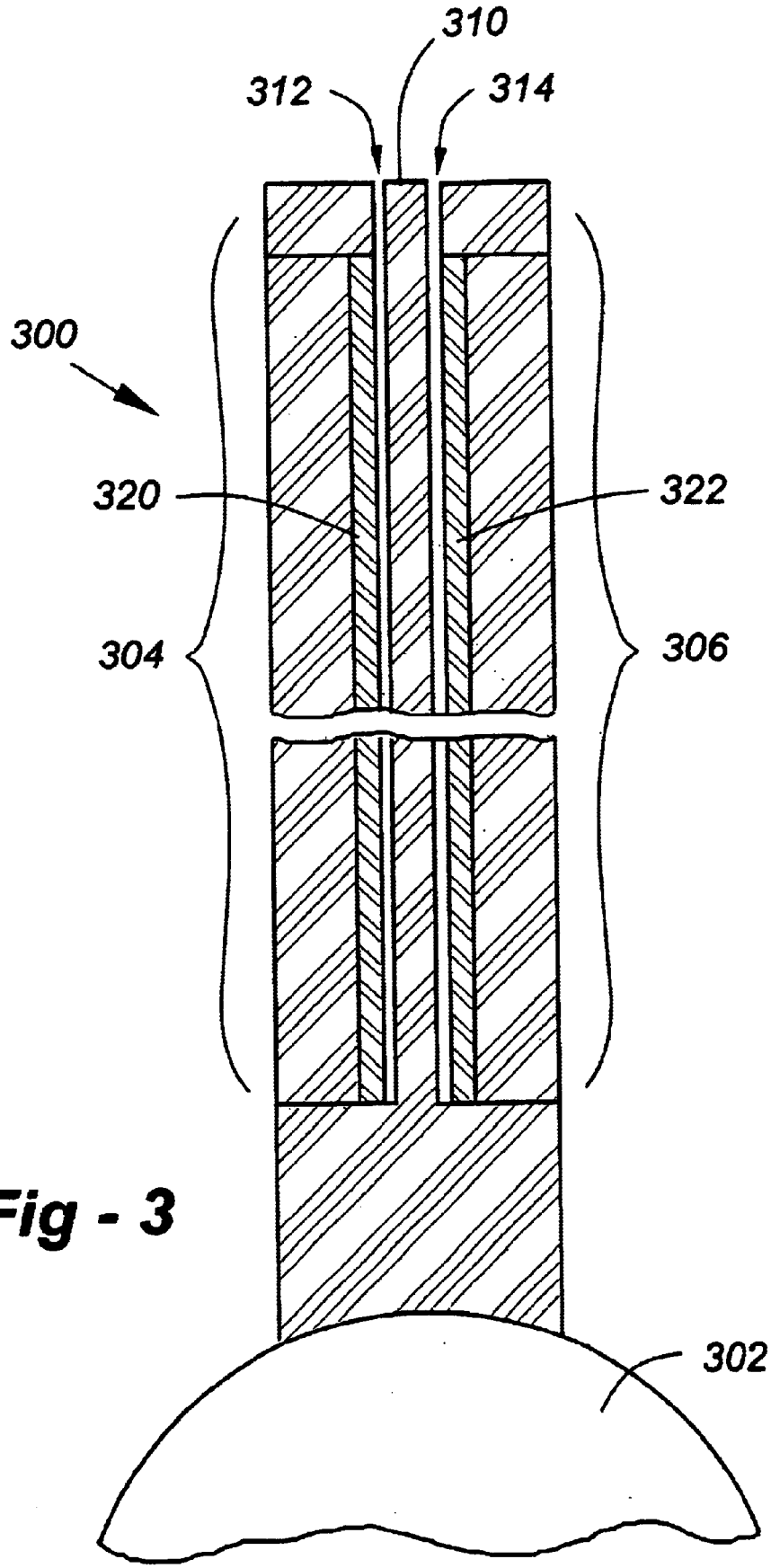
FIG. 3 is a drawing used to illustrate alternative embodiments of the invention.

FIG. 3 is a drawing used to illustrate alternative embodiments of the invention. A sign holder is shown generally at 300, which is integrally formed with a sleeve 302. As opposed to a fully integrated configuration using decals, paint, or other processes, the configuration of FIG. 3 includes one or more slots such as 312 and 314, into which signs may be inserted. In such a case, panels 320, 322 would preferably be made at least partially transparent, enabling the signs to show through the windows areas 304, 306 once installed. With a sign inserted into a respective slot, the slot may be left open with little chance for vandalism, though measures may also be taken to seal the slot off, through the use of tape, adhesive/caulking, or thermal weldment.

Figure 4:
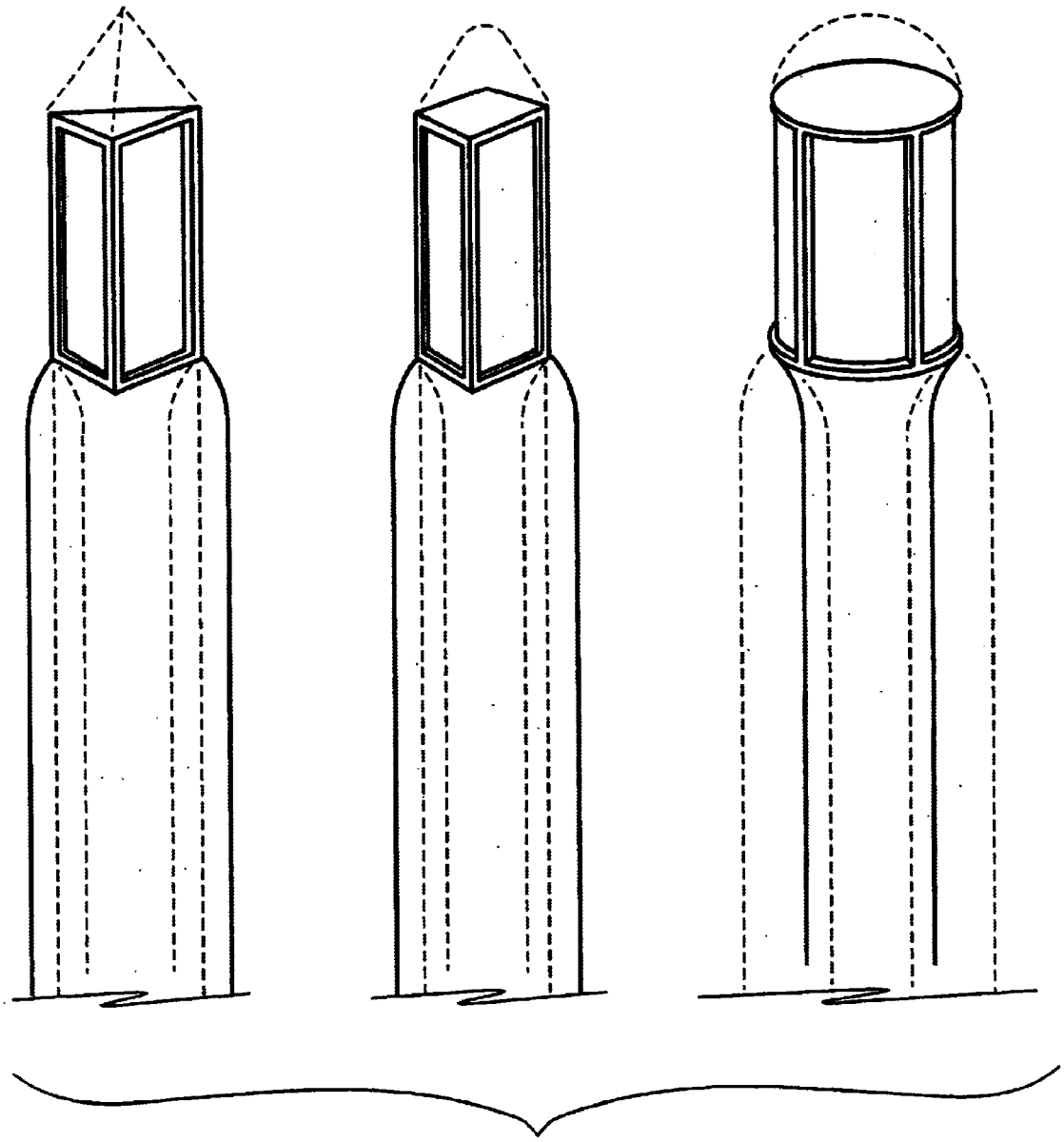
FIG. 4 illustrates further alternative embodiments of the invention allowing signed to be seen from additional perspectives.

In FIG. 3, the central panel 310 may be opaque or, if made transparent, it will be appreciated that two signs may be inserted back-to-back in one slot, while still enabling the sign to be seen from both sides. The use of signs visible from both sides is not a requirement of the invention, however, and only one side may be used, since there are applications such as the one depicted in FIG. 1 where a particular sign only makes sense from a certain vantage point. In the event that transparent panels such as 320 and 322 are integrally formed with the upper portion of the inventive cover, separate transparent/translucent panels may be provided, and may be held in place through tabs 110 and some form of fastener such as a self-tabbing screw 112. Finger holes such as 114 in FIG. 1 or 114' in FIG. 2 may be provided to lift out such a panel, if used. Again, adhesives or heat may be applied to hold components into place as opposed to separate fasteners. In addition, it will be appreciated that the various embodiments disclosed herein may be used separately or in combination; that is, a decal may be used on one side of a sign, whereas a slot or sign/protective cover may be used on the opposite side. Indeed, although two sign areas are shown in the figures, the inventive sleeve/sign holder of the invention may have three, four or more sides to provide signs from different perspectives, or may cylindrical in shape, as shown in FIG. 4.

Although FIG. 1 depicts a handicap parking sign, many other variations are possible, including, but not limited to:

Other parking sign configurations, such as parking for [a certain establishment or individual] only, employee of the month, visitors only, no parking/tow away zone, no parking during certain time or during construction, compact or motorcycle parking only, parallel parking only, do not back a vehicle into space, fire zone, temporary parking for pick up or delivery, taxi stop, service vehicles only, members/residents only;

Traffic signs, including, but not limited to, speed limit, construction zone, food/lodging (with or without

I claim:

1. A combined stanchion cover and signage system, comprising:

an elongated sleeve having a closed top and an open bottom defining a length, enabling the sleeve to be placed over a post or stanchion to be covered; and a message-receiving panel integrally formed with the sleeve into a one-piece unit using a polymeric molding process, the message receiving panel extending above the closed top of the sleeve, the panel having a height which is substantially less than the length of the sleeve.

2. The combined stanchion cover and signage system of claim 1, wherein the sleeve is generally cylindrical in shape.

3. The combined stanchion cover and signage system of claim 2, wherein the sleeve has an inner diameter in the range of 2 to 8 inches.

4. The combined stanchion cover and signage system of claim 1, wherein the message-receiving panel includes a recess or slot to receive a separate sign.

5. The combined stanchion cover and signage system of claim 1, wherein the message-receiving panel is in the form of a decal included during the integral molding process.

* * * * *

UNITED STATES PATENT AND TRADEMARK OFFICE

CERTIFICATE OF CORRECTION

PATENT NO. : 6,779,287 B2
DATED : August 24, 2004
INVENTOR(S) : Frank Venegas, Jr.

It is certified that error appears in the above-identified patent and that said Letters Patent is hereby corrected as shown below:

Title page,
Item [57], ABSTRACT,
Lines 3 and 5, replace “upped” with -- upper --

Column 1,
Lines 46 and 62, replace “upped” with -- upper --

Column 2,
Line 7, replace “form” with -- formed --.
Line 12, replace “signed” with -- signs --.
Line 47, replace “requires” with -- requirements --.
Line 50, replace “certainly” with -- certain --.

Column 3,
Line 26, replace “may cylindrical” with -- may be cylindrical --.
Line 30, replace “for [a” with -- for a --.
Line 31, replace “individual] only” with -- individual only --.

Column 4,
Line 7, delete “(with or without”

Signed and Sealed this

Twelfth Day of July, 2005

JON W. DUDAS
*Director of the United States Patent and Trademark Office*